US005864265A

United States Patent [19]

Ballance et al.

[11] Patent Number: 5,864,265

[45] Date of Patent: Jan. 26, 1999

[54] BANDSTOP FILTER MODULE WITH SHUNT ZERO

[75] Inventors: Mark Ballance; David R. Heine; Glenn Rice, all of Albuquerque, N. Mex.

[73] Assignee: Motorola Inc., Schaumburg, Ill.

[21] Appl. No.: 885,547

[22] Filed: Jun. 30, 1997

[51] Int. Cl.[6] ..... H01P 1/205; H01P 1/213

[52] U.S. Cl. ..... 333/206; 333/129; 333/134

[58] Field of Search ..... 333/202, 206, 333/207, 126, 129, 132, 134

[56] References Cited

U.S. PATENT DOCUMENTS

| | | | |
|---|---|---|---|
| 4,342,972 | 8/1982 | Nishikawa et al. | 333/206 |
| 4,673,902 | 6/1987 | Takeda et al. | 333/202 |
| 4,703,291 | 10/1987 | Nishikawa et al. | 333/202 |
| 5,132,651 | 7/1992 | Ishikawa et al. | 333/202 |
| 5,150,089 | 9/1992 | Komazaki et al. | 333/206 |
| 5,173,672 | 12/1992 | Heine | 333/206 |
| 5,202,654 | 4/1993 | Heine | 333/206 |
| 5,291,160 | 3/1994 | Ishikawa et al. | 333/202 |
| 5,386,203 | 1/1995 | Ishihara | 333/129 |
| 5,534,829 | 7/1996 | Kobayashi et al. | 333/206 X |
| 5,572,175 | 11/1996 | Tada et al. | 333/206 |
| 5,629,656 | 5/1997 | Tada et al. | 333/202 |
| 5,633,617 | 5/1997 | Tsujiguchi et al. | 333/206 |

FOREIGN PATENT DOCUMENTS

| | | | |
|---|---|---|---|
| 2-75203 | 3/1990 | Japan | 333/202 |
| 5-175708 | 7/1993 | Japan | 333/202 |
| 6-232605 | 8/1994 | Japan | 333/206 |

*Primary Examiner*—Seungsook Ham

*Attorney, Agent, or Firm*—Gary J. Cunningham; Colin M. Raufer

[57] ABSTRACT

A bandstop filter module (200) with a shunt zero is provided. The module (200) contains a circuit substrate (202) with input and output pads and transmission lines (208). The module (200) also contains at least one dielectric monolithic block (210) mounted to the circuit substrate (202) having a plurality of metallized through holes defining resonators (224) and guard holes (226). All surfaces of the dielectric monolithic block (210) are substantially covered with a conductive material with the exception that the top surface (212) is selectively metallized providing an unshorted metallization pattern (228) relative to a ground plane in proximity to the guard holes (226). The guard holes (226) and the unshorted metallization pattern (228) provide a shunt zero in a frequency response curve of the module (200). The module also contains means for coupling each of the resonators (224) with the transmission lines (208) on the circuit substrate (202). Other module components include at least one inductor coil (230) mounted on the circuit substrate (202) and a shield (232) having tuning windows.

10 Claims, 3 Drawing Sheets

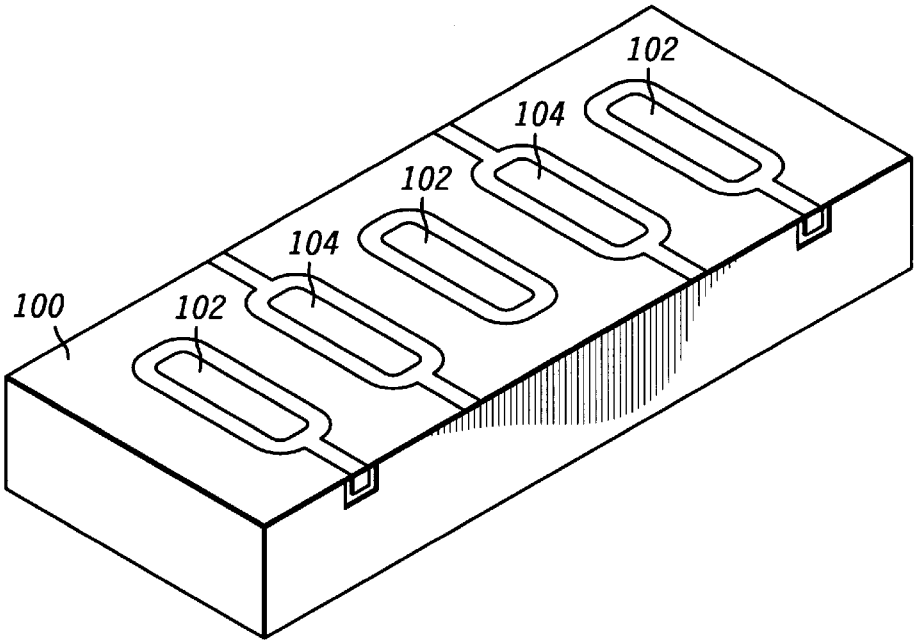
FIG. 1
-PRIOR ART-
FIG. 2A
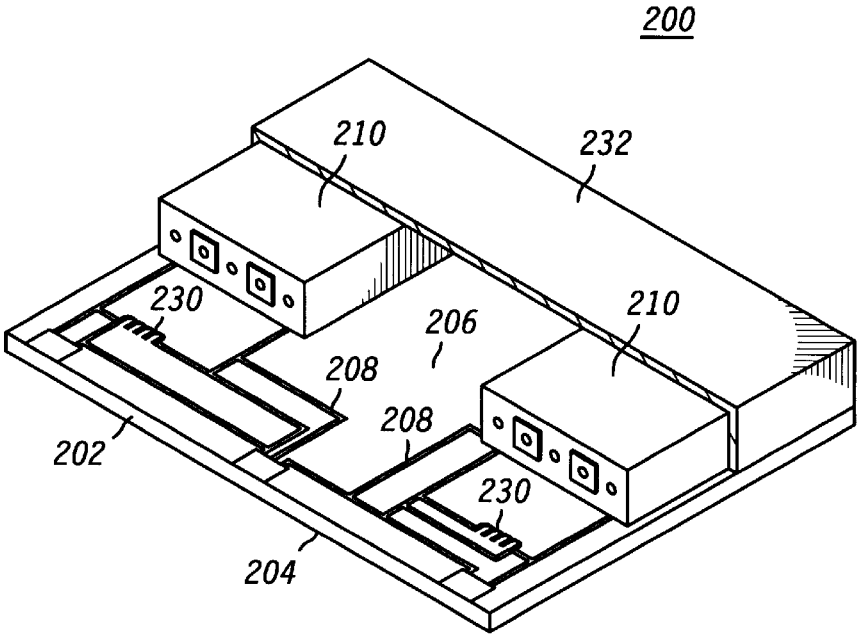

BANDSTOP FILTER MODULE WITH SHUNT ZERO

FIELD OF THE INVENTION

This invention relates to filters for frequency selectivity applications and, in particular, to a bandstop filter module with a shunt zero.

BACKGROUND OF THE INVENTION

The use of dielectric filters to selectively attenuate signals for electronic applications is well known in the art. Typically, this is accomplished using dielectric materials having metallized through holes formed therein to create one quarter wavelength resonators. The use of guard holes (also referred to as ground holes) to decouple consecutive resonators is also known in the art. FIG. 1 shows a prior art dielectric ceramic block filter 100 having guard holes 104 strategically placed between the resonators 102 to decouple the adjacent resonators. Heretofore, the guard holes have always been shorted (electrically connected to ground) at both the top and bottom surfaces of the filter block to achieve the desired electrical results. Shorting to ground is achieved by creating a continuously conductive path from the guard holes to the metallization on the sidewalls of the filter block. Also, prior art band reject filters have only provided rejection on either the high side or the low side of the passband.

Moreover, dielectric ceramic block filters have often been used as "stand alone" components that need to be integrated into the circuit board designs of a cellular telephone, for example. A bandstop filter module offers the advantages of additional integration by incorporating the dielectric monolithic block along with a circuit board, transmission lines, coil inductors and a shield to form the filter module.

Such a package offers the advantages of a small, compact, low-profile package which can be customized to meet specific radio architecture applications such as a duplexer, triplexer, or dual band filter module. Additionally, as more design features are placed directly into the filter module, less work is required by those designing the rest of the circuit board. Thus, a veritable "drop in" component can be designed which can perform elaborate filtering functions and requires only a predetermined footprint on the master circuit board.

A bandstop filter module which is designed to offer a shunt zero which creates a notch or a sharp point of increased attenuation in the frequency response and which is achieved by selectively leaving regions around the guard holes unmetallized on the top surface of a dielectric block, and where the bandstop filter module offers the advantages of additional integration in a low profile, small, compact, customized filter package, would be considered an improvement in the art.

BRIEF DESCRIPTION OF THE DRAWINGS

FIG. 1 shows a dielectric ceramic block filter having guard holes in accordance with the prior art.

FIG. 2A shows a bandstop filter module with a shunt zero in accordance with the present invention.

DETAILED DESCRIPTION OF THE PREFERRED EMBODIMENT

Figure 2B:
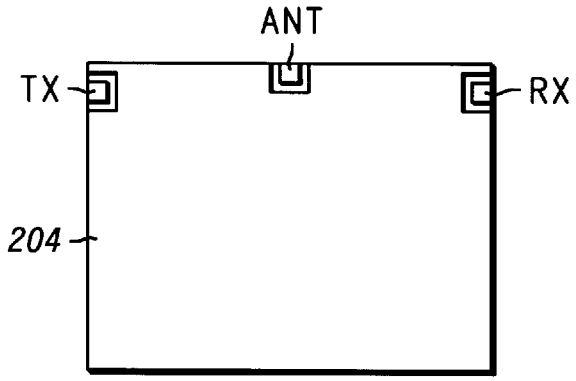
FIG. 2B shows a view of the input and output pad layout on a circuit substrate.

FIG. 2A shows a bandstop filter module 200 with a shunt zero. Filter module 200 contains a circuit substrate 202 which may be manufactured from a printed circuit board material. Circuit substrate 202 has a first major surface 204 with input and output pads deposited thereon. FIG. 2B shows a view of the input and output pad layout on the circuit substrate 202 for a duplexer filter module. Referring to FIG. 2B, a transmit (Tx), a receive (Rx) and an antenna port (ANT) are shown on the first major surface 204 (the bottom surface) of the filter substrate. Of course, for other embodiments of the present invention, including the triplexer and the dual band filter module, additional input and output pads may be placed on the first major surface 204 to accommodate the additional components mounted on the other side surface of the filter module.

Referring again to FIG. 2A, the circuit substrate 202 also contains a second major surface 206 with transmission lines 208 deposited thereon. The input and output pads (Tx, Rx, and ANT in FIG. 2B) are connected to at least one of the transmission lines 208 through the circuit substrate 202. Moreover, the second major surface 206 also contains real estate on which the other components of the filter module will be mounted. The circuit substrate 202 may be made from any dielectric material. In a preferred embodiment, the circuit substrate 202 comprises an epoxy-resin or Teflon-coated printed circuit board material.

Figure 2C:
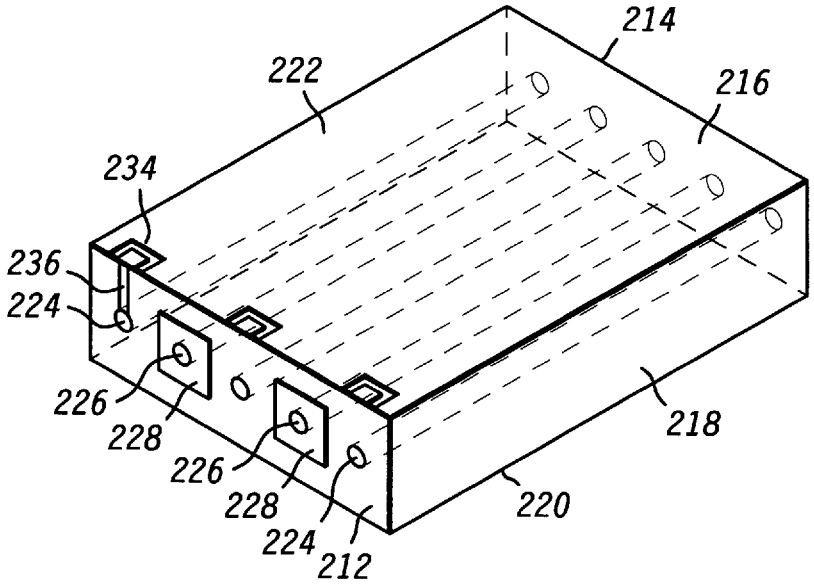
FIG. 2C shows a view of a dielectric monolithic block.

Filter module 200 also contains at least one dielectric monolithic block 210 mounted to the circuit substrate 202. FIG. 2C shows a perspective view of a dielectric monolithic block 210. Each of the dielectric monolithic blocks, as shown in FIG. 2C has a substantially rectangular body made of a dielectric material which is typically ceramic and which typically has a high dielectric constant. The dielectric monolithic block 210 has a top surface 212, a bottom surface 214, and four side surfaces 216, 218, 220, 222. The dielectric monolithic blocks also contain a plurality of metallized through holes extending from the top surface 212 to the bottom surface 214 defining resonators 224 and a plurality of metallized through holes extending from the top surface 212 to the bottom surface 214 adjacent to the resonators 224 defining guard holes 226. The guard holes 226 and the resonators 224 need not have the same diameter or cross-sectional shape, however, in one embodiment, they may be the same size and shape. All surfaces (212, 214, 216, 218, 220, 222) of the dielectric monolithic block 210 are substantially covered with a conductive material defining a metallized ground layer.

Dielectric monolithic blocks 210 are mounted directly to the circuit substrate 202. Typically, the blocks will be mounted such that the resonators 224 are parallel to the circuit substrate 202. The monolithic blocks are typically attached to the circuit substrate using a reflow operation using conventional reflow temperatures. It should be noted that each of the individual resonators 224 has its own corresponding pad 234 for connecting the resonator 224 to the circuit substrate 202. Typically, this will take the form of an input/output pad 234 as shown in FIG. 2C. However, other methods of tapping into the resonators, such as connecting directly to the through holes, may also be employed in other embodiments of the present invention. Moreover, when input/output pads 234 are employed, there will typically be capacitive coupling through the dielectric monolithic block 210 into the resonator through hole. However, another direct coupling technique may also be used to connect the resonator 224 to the circuit substrate 202. Referring to FIG. 2C, a direct connection region 236 is shown connecting one of the resonators 224 to the circuit substrate 202.

An important feature of the present invention is that the top surface 212 is selectively metallized providing an unshorted metallization pattern 228 relative to a ground plane or ground layer (the ground plane or ground layer being the other metallized surfaces of the dielectric monolithic block) in proximity to the guard holes. Typically, dielectric filters which have guard holes have a shorting metallization pattern on the top surface of the filter which electrically connects a top end of the metallized guard hole to a ground plane. The guard holes 226 and the unshorted (non-shorted) metallization pattern 228 relative to a ground plane in proximity to the guard holes on the top surface 212 of the dielectric monolithic block 210 provide a shunt zero with a notch in the frequency response as shown in the frequency response curve of the bandstop filter module 200 (see FIG. 3).

The actual method employed to achieve the unshorted guard hole effect can be varied. For example, one method would be to metallize the entire top surface and then selectively remove metallization as another processing step. Other ways of unshorting the guard holes include dremeling, selective screen printing, spraying, sand blasting, or selective dipping. So long as the guard holes are unshorted, and thus act as quarter-wave resonators, the actual pattern which creates the shorting effect may also be varied. For example, in a preferred embodiment, a rectangular unmetallized region between the guard holes and the side surfaces of the dielectric monolithic block will create the unshorted effect. However, in other embodiments, an unmetallized crescent shaped region or other pattern may create the unshorted effect.

Referring again to FIG. 2A, a means for coupling each of the plurality of metallized through-holes defining one quarter or one half wavelength resonators 224 with the transmission lines 208 on the circuit substrate 202 must also be provided. This is usually accomplished using a capacitive coupling technique to tap into and out of the resonators 224. Also in FIG. 2A, at least one inductor coil 230 is mounted on the circuit substrate 202 immediately adjacent the top surface 212 of the dielectric monolithic block 210.

A shield 232 provides a covering mechanism and is another component of the filter module 200. A metallized shield 232 is connected to the circuit substrate 202 and serves the purpose of reducing EMI, increasing electrical isolation, or providing a cosmetic package. A shield 232 having tuning windows is mounted to the circuit substrate 202 encasing both the dielectric monolithic blocks 210 and the inductor coil 230. Altogether, the various components complete the bandstop filter module with shunt zero assembly. The tuning windows are aligned directly over the dielectric monolithic blocks 210 so as to allow tuning of the blocks as necessary. In a preferred embodiment, the shield is made from a metal plated material and the tuning windows are substantially aligned with the top surface of the dielectric monolithic block. Moreover, any number of tuning windows may be strategically placed within the shield so long as the shielding properties and mechanical integrity of the shield is maintained. Tuning windows are provided as dashed lines in FIG. 2A.

Figure 3:
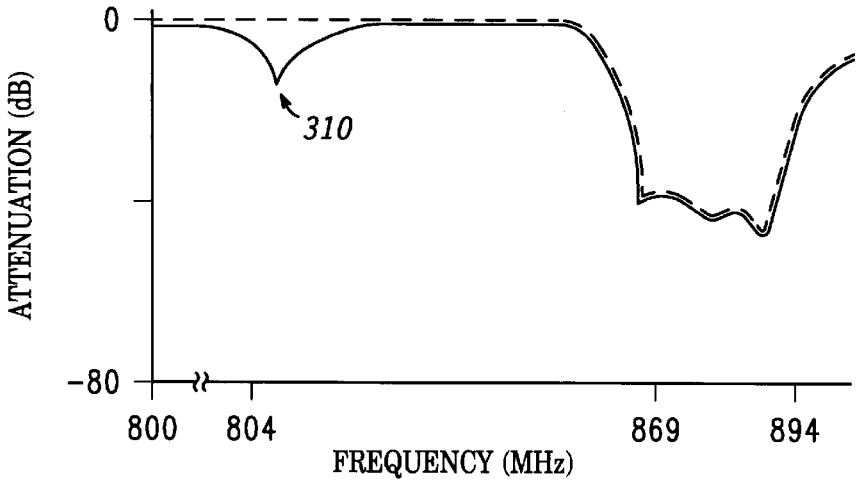
FIG. 3 shows the frequency response curves for a bandstop filter module having both electrically shorted and electrically unshorted guard holes.

FIG. 3 shows the frequency response curves for a bandstop filter module having both shorted and unshorted guard holes. Attenuation, measured in decibels (dB), is shown along the y-axis and Frequency, measured in megahertz (MHz), is shown along the x-axis. As can be seen from FIG. 3, the frequency response curve for a filter module having shorted guard holes is shown as a dashed line. However, when the guard holes (226 in FIG. 2C) have a predetermined electrode pattern around them such that the guard holes are unshorted relative to the ground plane on the other metallized surfaces of the dielectric monolithic block (228 in FIG. 2C), it becomes apparent that additional shunt zeros (310 in FIG. 3) may be created in the passband which may be may offer advantages to the filter module designer.

Moreover, although the additional zero is shown on the low side of the passband in FIG. 3, in other embodiments, the zero could be placed at other locations in the passband, on the high side of the passband, for example. Thus, the present invention offers additional attenuation or stopbands, without increasing the size of the dielectric monolithic block, by unshorting the guard holes. The placement of the zero will depend on the custom specifications of the individual filter design and can be tailored to meet specific applications.

Band reject filters are desirable in applications where second and third harmonic suppression is needed. However, band reject filters typically offer attenuation or rejection on either the high side or the low side of the passband, but usually not both. One advantage of the present invention is that by leaving the top surfaces of the dielectric filter block, in vicinity to the guard holes, unshorted relative to the ground plane, an additional zero can be created. The frequency of this additional zero may be tuned to a frequency outside of the band reject region, offering a design advantage which was unavailable in the past.

Moreover, it is to be noted that the present invention is not limited in its application to the ¼ wavelength coaxial TEM resonators alone described in the foregoing embodiment, but may be applicable to ½ wavelength TEM resonators or the like depending upon necessity and design specifications.

It should also be noted here that all embodiments of the present invention may employ either coaxial resonators having a through hole with a substantially rectangular cross section or a substantially oval cross section or a substantially circular cross section, or any combination thereof, depending upon the specific filter design.

A filter is achieved by providing a layer of metal film, hereinafter called a metallization or electrode layer, at predetermined positions on the dielectric block. A metallization layer is also deposited on the circuit substrate 202 in the form of transmission lines 208. While a preferred embodiment may have electrodes made of silver, other embodiments may have electrodes made of copper, platinum, gold or the like.

Figure 4:
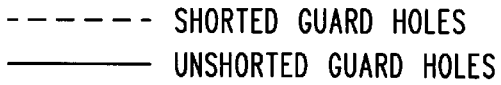
FIG. 4 shows a plan view of a bandstop filter module for a duplexer filter.
Figure 4:
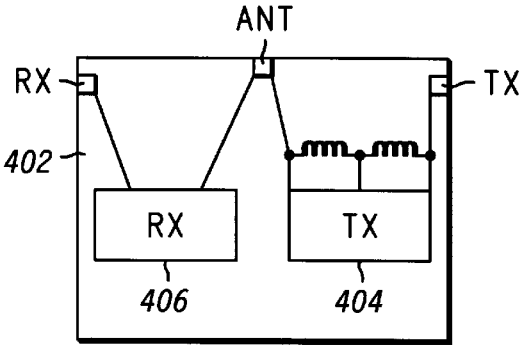

Various different board layouts for the bandstop filter module are provided in FIG'S 4 through 6. FIG. 4 shows a plan view of a bandstop filter module for a duplexer filter. Referring to FIG. 4, a circuit substrate 402 has a transmit dielectric monolithic block 404 mounted thereon as well as a receive dielectric monolithic block 406 mounted thereon to create a duplexer bandstop filter module. Other components of the duplexer filter module have been described with reference to FIG. 2A and those components are incorporated herein by reference.

Figure 5:
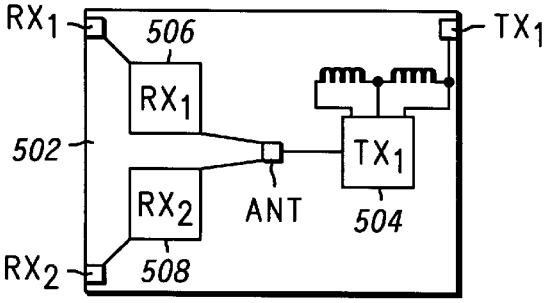
FIG. 5 shows a plan view of a bandstop filter module for a triplexer filter.

FIG. 5 shows a plan view of a bandstop filter module for a triplexer filter. Referring to FIG. 5, a circuit substrate 502 has a transmit dielectric monolithic block 504 mounted thereon as well as a first receive dielectric monolithic block 506 and a second receive dielectric monolithic block 508 mounted thereon to create a triplexer bandstop filter module. Other components of the triplexer filter module have been described with reference to FIG. 2A and those components are incorporated herein by reference.

Figure 6:
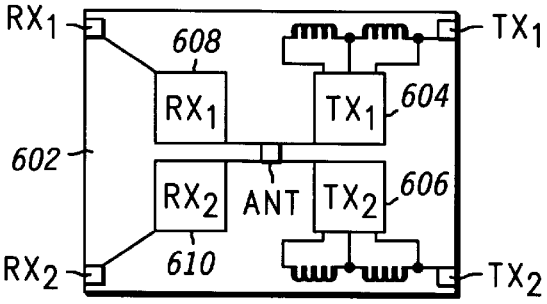
FIG. 6 shows a plan view of a bandstop filter module for a dual band filter.

FIG. 6 shows a plan view of a bandstop filter module for a dual band filter (also called a dual mode filter). A dual band bandstop filter module may have many applications in emerging telecommunications applications in which many different bands of the frequency spectrum are utilized. Referring to FIG. 6, a circuit substrate 602 has a first transmit dielectric monolithic block 604 and a second transmit dielectric monolithic block 606 mounted thereon as well as a first receive dielectric monolithic block 608 and a second receive dielectric monolithic block 610 mounted thereon to create a dual band bandstop filter module. Other components of the dual band filter module have been described with reference to FIG. 2A and those components are incorporated herein by reference. Of course, the present invention is not intended to be limited to merely a dual band bandstop filter module, but rather may contain as many dielectric monolithic blocks as may feasibly be contained in a single filter module.

In another embodiment of the present invention, chip inductors may be used in lieu of inductor coils. This may be necessary to reduce the size of the filter module or to provide an alternative fabrication method for a specific application.

All embodiments of the present invention will have at least one bandstop filter with a shunt zero. However, the additional dielectric monolithic blocks of the duplexer, triplexer, and dual band filter modules may be either bandpass or bandstop and may or may not incorporate the shunt zero feature.

Although various embodiments of this invention have been shown and described, it should be understood that various modifications and substitutions, as well as rearrangements and combinations of the preceding embodiments can be made by those skilled in the art, without departing from the novel spirit and scope of this invention.

What is claimed is:

1. A bandstop filter module with a shunt zero, comprising:

a circuit substrate having a first major surface with input and output pads deposited thereon and a second major surface with transmission lines deposited thereon, the input and output pads connected to at least one of the transmission lines through the circuit substrate;

at least one dielectric monolithic block mounted to the circuit substrate each dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the dielectric monolithic block being substantially covered with a conductive material defining a metallized ground layer with the exception that the top surface is selectively metallized providing an unshorted metallization pattern relative to a ground plane in proximity to the guard holes;

the guard holes and the unshorted metallization pattern relative to a ground plane in proximity to the guard holes on the top surface of the dielectric monolithic block provide a shunt zero in a frequency response curve of the bandstop filter module; the guard holes operating at a frequency which is different than the frequency of the resonators thereby decoupling the resonators and thus providing additional harmonic rejection;

a plurality of coupling pads on one of the four side surfaces of the dielectric monolithic block, each of the plurality of coupling pads corresponding with each of the plurality of metallized through holes extending from the top surface to the bottom surface defining resonators, each of the plurality of coupling pads providing capacitive coupling through the dielectric monolithic block into each of the respective resonators;

at least one inductor coil mounted on the substrate immediately adjacent the top surface of the dielectric monolithic block; the at least one inductor coil coupled at one end thereof to a first of the resonators via a first of the transmission lines and coupled at another end thereof to a second of the resonators via a second of the transmission lines; the at least one inductor coil providing inductive coupling between the first of the resonators and the second of the resonators; and a shield having tuning windows mounted to the circuit substrate encasing the at least one dielectric monolithic block and the inductor coil.

2. The bandstop filter module of claim 1, wherein the inductor coil is a chip inductor.

3. The bandstop filter module of claim 1, wherein the dielectric filter is mounted to the circuit substrate such that both the resonators and the guard holes extend parallel to the first major surface and the second major surface of the circuit substrate.

4. The bandstop filter module of claim 1, wherein the shield is made from a metal coated material and the tuning windows are substantially aligned with the top surface of the dielectric monolithic block.

5. The bandstop filter module of claim 1, wherein the resonators are quarter-wave dielectric resonators.

6. The bandstop filter module of claim 1, wherein the resonators are half-wave dielectric resonators.

7. The bandstop filter module of claim 1, wherein the circuit substrate comprises an epoxy-resin printed circuit board material.

8. A duplexer bandstop filter module with a shunt zero, comprising:

a circuit substrate having a first major surface with input and output pads deposited thereon and a second major surface with transmission lines deposited thereon, the input and output pads connected to at least one of the transmission lines through the circuit substrate;

a transmit dielectric monolithic block mounted to the circuit substrate, the transmit dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the transmit dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the transmit dielectric monolithic block, each of the plurality of coupling pads corresponding with each of the plurality of metallized through holes extending from the top surface to the bottom surface defining resonators, each of the plurality of coupling pads providing capacitive coupling through the transmit dielectric monolithic block into each of the respective resonators;

a receive dielectric monolithic block mounted to the circuit substrate, the receive dielectric monolithic block having a substantially rectangular body made of a dielectric material and having a top surface, a bottom surface, four side surfaces and having a plurality of metallized through holes extending from the top surface to the bottom surface defining resonators and a plurality of metallized through holes extending from the top surface to the bottom surface adjacent to the resonators defining guard holes, and all surfaces of the receive dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the receive dielectric monolithic block, each of the plurality of coupling pads corresponding with each of the plurality of metallized through holes extending from the top surface to the bottom surface defining resonators, each of the plurality of coupling pads providing capacitive coupling through the receive dielectric monolithic block into each of the respective resonators;

the guard holes and the unshorted metallization pattern relative to the ground plane in proximity to the guard holes on the top surfaces of the transmit and receive dielectric monolithic blocks provide a shunt zero in the frequency response curves of a transmit and a receive dielectric filter respectively; the guard holes operating at a frequency which is different than the frequency of the resonators thereby decoupling the resonators and thus providing additional harmonic rejection;

at least one inductor coil mounted on the circuit substrate immediately adjacent the top surface of the transmit and receive dielectric monolithic blocks; the at least one inductor coil coupled at one end thereof to a first of the resonators of the transmit dielectric monolithic block via a first of the transmission lines and coupled at another end thereof to a second of the resonators of the transmit and receive dielectric monolithic block via a second of the transmission lines; the at least one inductor coil providing inductive coupling between the first of the resonators and the second of the resonators; and a shield having tuning windows mounted to the circuit substrate encasing the transmit and receive dielectric monolithic blocks and the inductor coil.

9. A triplexer bandstop filter module with a shunt zero, comprising:

a circuit substrate having a first major surface with input and output pads deposited thereon and a second major surface with transmission lines deposited thereon, the input and output pads connected to at least one of the transmission lines through the circuit substrate;

a transmit dielectric monolithic block mounted to the circuit substrate, the transmit dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the transmit dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the transmit dielectric monolithic block, each of the plurality of coupling pads corresponding with each of the plurality of metallized through holes extending from the top surface to the bottom surface defining resonators, each of the plurality of coupling pads providing capacitive coupling through the transmit dielectric monolithic block into each of the respective resonators;

a first receive dielectric monolithic block mounted to the circuit substrate, the first receive dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the first receive dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the first receive dielectric monolithic block, each of the plurality of coupling pads corresponding with each of the plurality of metallized through holes extending from the top surface to the bottom surface defining resonators each of the plurality of coupling pads providing capacitive coupling through the first receive dielectric monolithic block into each of the respective resonators;

a second receive dielectric monolithic block mounted to the circuit substrate, the second receive dielectric monolithic block having a frequency response curve and a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the second receive dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the second receive dielectric monolithic block, each of the plurality of coupling pads corresponding with each of the plurality of metallized through holes extending from the top surface to the bottom surface defining resonators, each of the plurality of coupling pads providing capacitive coupling through the second receive dielectric monolithic block into each of the respective resonators;

the guard holes and the unshorted metallization pattern in proximity to the guard holes on the top surface of the transmit dielectric monolithic block and the first receive dielectric monolithic block and the second receive dielectric monolithic block provide a shunt zero in the frequency response curves of a transmit dielectric filter and a first receive dielectric filter and a second receive dielectric filter respectively; the guard holes operating at a frequency which is different than the frequency of the resonators thereby decoupling the resonators and thus providing additional harmonic rejection;

at least one inductor coil mounted on the substrate immediately adjacent the top surface of the transmit dielectric monolithic block and the first receive dielectric monolithic block and the second receive dielectric monolithic block; the at least one inductor coil coupled at one end thereof to a first of the resonators of the transmit dielectric monolithic block via a first of the transmission lines and coupled at another end thereof to a second of the resonators of the transmit dielectric monolithic block via a second of the transmission lines; the at least one inductor coil providing inductive coupling between the first of the resonators and the second of the resonators; and a shield having tuning windows mounted to the circuit substrate encasing the transmit and receive dielectric monolithic blocks and the inductor coil.

10. A dual band bandstop filter module with a shunt zero, comprising:

a circuit substrate having a first major surface with input and output pads deposited thereon and a second major surface with transmission lines deposited thereon, the input and output pads connected to at least one of the transmission lines through the circuit substrate;

a first transmit dielectric monolithic block mounted to the circuit substrate, the first transmit dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the first transmit dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the first transmit dielectric monolithic block, each of the plurality of coupling pads corresponding with each of the plurality of metallized through holes extending from the top surface to the bottom surface defining resonators, each of the plurality of coupling pads providing capacitive coupling through the first transmit dielectric monolithic block into each of the respective resonators;

a second transmit dielectric monolithic block mounted to the circuit substrate, the second transmit dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the second transmit dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the second transmit dielectric monolithic block, each of the plurality of coupling pads corresponding with each of the plurality of metallized through holes extending from the top surface to the bottom surface defining resonators, each of the plurality of coupling pads providing capacitive coupling through the second transmit dielectric monolithic block into each of the respective resonators;

a first receive dielectric monolithic block mounted to the circuit substrate, the first receive dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the first receive dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the first receive dielectric monolithic block, each of the plurality of coupling pads corresponding with each of the plurality of metallized through holes extending from the top surface to the bottom surface defining resonators, each of the plurality of coupling pads providing capacitive coupling through the first receive dielectric monolithic block into each of the respective resonators;

a second receive dielectric monolithic block mounted to the circuit substrate, the second receive dielectric monolithic block having a substantially rectangular body made of a dielectric material and having a top surface, a bottom surface, four side surfaces and having a plurality of metallized through holes extending from the top surface to the bottom surface defining resonators, and a plurality of metallized through holes extending from the top surface to the bottom surface adjacent to the resonators defining guard holes, and all surfaces of the second receive dielectric monolithic block being substantially covered with a conductive material defining a metallized ground layer with the exception that the top surface is selectively metallized providing an unshorted metallization pattern relative to a ground plane in proximity to the guard holes;

a plurality of coupling pads on one of the four side surfaces of the second receive dielectric monolithic block, each of the plurality of coupling pads corresponding with each of the plurality of metallized through holes extending from the top surface to the bottom surface defining resonators, each of the plurality of coupling pads providing capacitive coupling through the second receive dielectric monolithic block into each of the respective resonators;

the guard holes and the unshorted metallization pattern in proximity to the guard holes on the top surface of the first transmit dielectric monolithic block and the second transmit dielectric monolithic block and the first receive dielectric monolithic block and the second receive dielectric monolithic block provide a shunt zero in the frequency response curves of a first transmit dielectric filter and a second transmit dielectric filter and a first receive dielectric filter and a second receive dielectric filter respectively; the guard holes operating at a frequency which is different than the frequency of the resonators thereby decoupling the resonators and thus providing additional harmonic rejection;

at least one inductor coil mounted on the substrate immediately adjacent the top surface of the first transmit dielectric monolithic block and the second transmit dielectric monolithic block and the first receive dielectric monolithic block and the second receive dielectric monolithic block; the at least one inductor coil coupled at one end thereof to a first of the resonators of the first or second transmit dielectric monolithic block via a first of the transmission lines and coupled at another end thereof to a second of the resonators of the first or second dielectric monolithic block via a second of the transmission lines; the at least one inductor coil providing inductive coupling between the first of the resonators and the second of the resonators; and a shield having tuning windows mounted to the circuit substrate encasing the transmit and receive dielectric monolithic blocks and the inductor coil.

* * * * *